US007165740B2

(12) United States Patent
Badiali et al.

(10) Patent No.: US 7,165,740 B2
(45) Date of Patent: Jan. 23, 2007

(54) TRAVELLING SERVICE DEVICE FOR OPEN-END SPINNING UNITS OF OPEN-END SPINNING MACHINES

(75) Inventors: Roberto Badiali, Pordenone (IT); Vittorio Colussi, Cappella Maggiore (IT); Donato Castellarin, Azzano Decimo (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 16 days.

(21) Appl. No.: 10/964,477

(22) Filed: Oct. 13, 2004

(65) Prior Publication Data

US 2005/0082415 A1 Apr. 21, 2005

(30) Foreign Application Priority Data

Oct. 16, 2003 (IT) ..... MI2003A2003

(51) Int. Cl.
*B65H 54/26* (2006.01)

(52) U.S. Cl. ..... 242/473.7

(58) Field of Classification Search ..... 242/473.7, 242/475.8, 475.7, 481.8; 57/22, 263
See application file for complete search history.

(56) References Cited

U.S. PATENT DOCUMENTS

| | | | | |
|---|---|---|---|---|
| 4,438,624 | A * | 3/1984 | Mayer et al. | 57/352 |
| 4,634,064 | A * | 1/1987 | Burkhard et al. | 242/476.3 |
| 5,159,804 | A | 11/1992 | Schippers et al. | |
| 5,285,975 | A | 2/1994 | Mayer et al. | |
| 5,393,002 | A * | 2/1995 | Greis et al. | 242/475.8 |
| 6,272,832 | B1 | 8/2001 | Gobbels et al. | |

OTHER PUBLICATIONS

EPO Search Report, May 9, 2005.

* cited by examiner

*Primary Examiner*—Kathy Matecki
*Assistant Examiner*—William E. Dondero
(74) *Attorney, Agent, or Firm*—Hedman & Costigan; James V. Costigan

(57) ABSTRACT

Service trolley for open-end spinning machines having on-board members dedicated to the intervention cycles comprising a device for determining the position of the thread with respect to such members of the trolley that comprises a worm screw, with a horizontal axis parallel to the spinning machine, which engages the thread with its threading, said device being able to be lifted and actuated in commanded clockwise/anti-clockwise rotation to determine both the level of the thread and its axial coordinate.

8 Claims, 9 Drawing Sheets

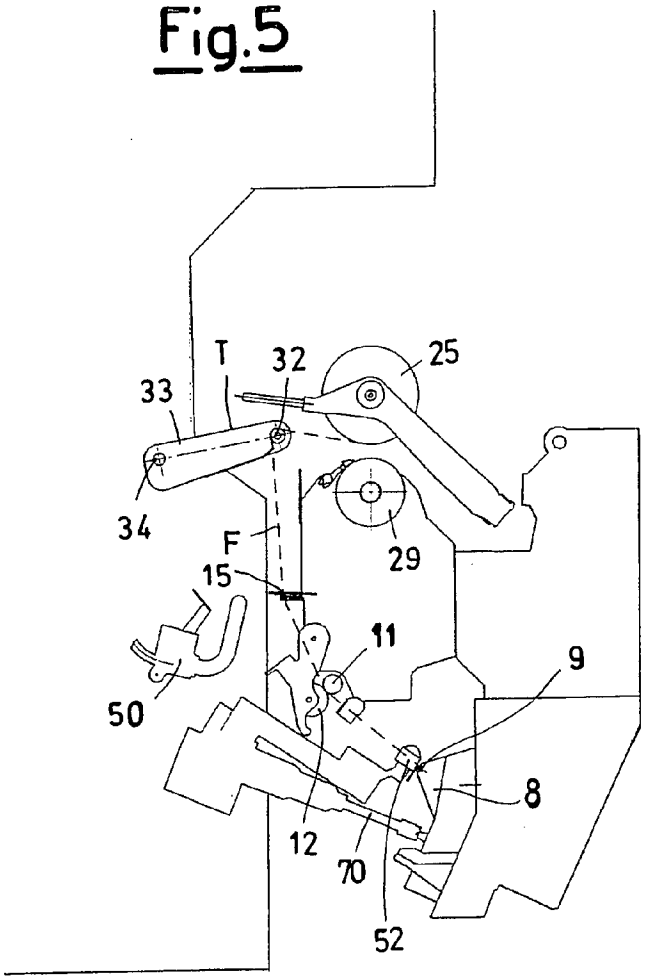
Fig.5
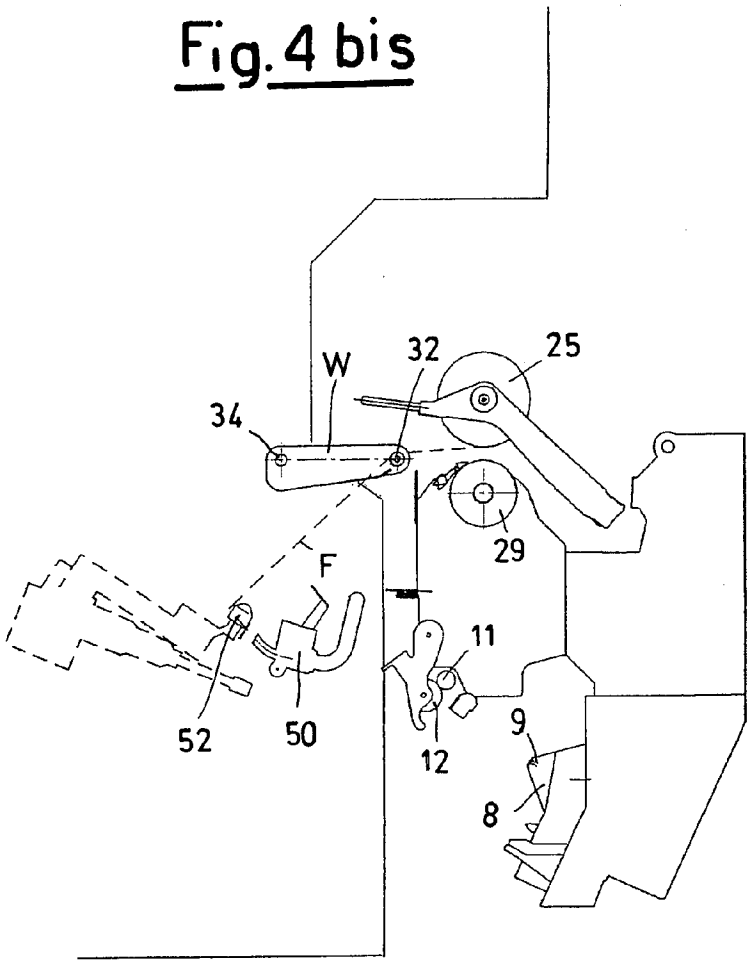
Fig.4 bis

TRAVELLING SERVICE DEVICE FOR OPEN-END SPINNING UNITS OF OPEN-END SPINNING MACHINES

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

The present invention refers to open end spinning, or rotor spinning. Open-end spinning machines generally consist of a plurality of individual spinning units, aligned on the two sides of the machine, each of which is made up of a spinning rotor, which produces twisted thread from singularised fibres of a rove, and a collection unit that—with the prior quality control of yarn with the interposition of a yarn clearer between the two components—carries the yarn to wind onto a quill to form a cone. This cone is thus formed pulling and winding the yarn on its surface, being pulled into rotation by the roller below on which the cone in formation is rested. The yarn is wound in a spiral on the cone in rotation since the collection unit is equipped with a thread-guiding device that distributes the yarn on the outer surface of the cone with to and fro axial motion.

The structure of the individual spinning station is illustrated in the scheme of FIG. 1, and its operation according to its normal running is briefly described hereafter.

Proceeding from the bottom towards the top, the single spinning station 1 consists of the actual spinning unit 2 and the collection unit 3, the main components of which that lead to the transformation of the rove of fibres made to run parallel in the cone of wound yarn are briefly illustrated hereafter.

The supply band or rove S is contained in a cylindrical vessel 4 where it is deposited in a double spiral. The rove S is supplied to the unit by a supply roller 5 passing through the funnel-shaped conveyor 6 and reaches the card 7, a rotating roller equipped with a toothed trimming that singularises the fibres of the rove S and conveys them by suction to the spinning rotor 8, which works in a vacuum.

In the spinning rotor 8, which rotates at very high speeds (up to 150,000 revs/minute and beyond), the singularised fibres are deposited in its peripheral throat by centrifugal effect; from here they are collected and picked up in the form of thread F, coming out axially from its central opening 9, receiving the twists from the rotation of the rotor itself in the path that runs between its inner throat and such an opening 9, thus generating the twisted thread F.

The pulling back of the thread is carried out with a pair of opposite extraction cylinders 11 and 12 for gripping the thread F and actuated at a controlled speed according to the arrow a, thus determining the linear production of yarn, generally indicated in m/min. The yarn clearer 14 for controlling the quality of the yarn F can be placed before the cylinders 11/12. The thread F thus produced enters into the collection unit 3, passes by a sensor 15 of the presence of thread and meets a compensator 16 for compensating the variations in length of the path between the spinning unit 2 and the deposit point of the yarn F on the cone. The thread-guiding device 21 distributes the thread on the cone in formation moving transversally with to and fro motion according to the double arrow b, actuated by a motor 20 that commands a longitudinal shaft 22 in common with the other units of the spinning machine.

The cone 25 collects the thread F and is held by the cone-holding arm 26 equipped with two idle tailstocks 27 that can be opened that go into engagement with the basic quill 28 of the cone. The cone in formation 25 is rested upon its actuation roller or collection cylinder 29.

2) Description of Related Art

Recently conceived automatic open-end spinning machines are equipped with service trolleys that patrol the sides of the spinning machine and carry out the required interventions stopping in front of the spinning unit that requires it.

The required interventions are essentially of three types:

for starting, at the beginning of the spinning from a still spinning machine, starting it and then placing a new quill in each station, carrying out the start-up with an auxiliary thread and winding the thread produced on the new quill to give a cone, after having eliminated that portion of auxiliary thread;

for reattachment, when the yarn is interrupted for whatever reason, without having yet reached the length foreseen for completing the cone, using the yarn already produced by the side of the cone, carrying out the reattachment and continuing the winding on the same cone. The reattachment procedure essentially consists of the opening, cleaning and closing of the rotor, the preparation of the tail of the rove, the capturing and preparation of the end at the side of the cone, the restarting of the rotor and the continuation of the supply, the re-introduction into the rotor of the prepared end, the re-extraction of the end connected to the newly produced thread winding it once again in the collection unit. The programmed cleaning cycle is the equivalent to the reattachment cycle, caused with a commanded breaking of the thread;

for lifting, after having reached the foreseen length for the cone to be complete. The finished cone is discharged and then one proceeds to starting the unit as outlined above.

Generally, such interventions are carried out by separating the cone 25 from its actuation cylinder 29, stopping its motion and actuating the cone 25 or its quill 28 by an auxiliary actuation roller arranged on-board the service trolley.

In the field of devices and procedures for the intervention of service trolleys on automated open end spinning machines the applicant is the owner, amongst others, of patents IT 1.146.694, EP 340.863, EP 443.220, EP 473.212, IT 1.258.220, IT 1.258.221, IT 1.258.222.

In general, the automation trolley consists of a structure mobile along the sides of the machine, a communication system with the central control unit of the spinning machine and with the spinning unit that make up the machine, a translation and stopping system of the trolley in front of the units that require intervention. The mobile structure carries on-board both its control unit and the members or groups of members dedicated to the single or multiple operations of the various cycles, which can at various times be required and which can be managed by said control unit. In open-end spinning machines that are currently available the automation trolley, faced with a failed reattachment or lifting cycle, repeats the operating sequence of the cycle from the beginning for a certain number of times, in general not more than three so as not to compromise the overall efficiency of the spinning machine.

The spinning unit, after said failed attempts of the trolley, is left out of order (with a red light) requiring the inspection of the operator who must identify the cause of the negative outcome of the automatic intervention and manually take steps to prepare it for a further intervention, again to be conducted automatically, but this time with a positive outcome.

With the evolution of open-end spinning machine technology, the range of counts, of yarns and of fibres to be worked has substantially widened, whereas the quality specifications of yarn have become more stringent. With the overall cycles relative to reattachment and lifting in which a substantial number of members or groups of members on-board the trolley cooperate, its efficiency, in other words, the successful completion of the operation without carrying out many attempts over and again, is very important. The coordination of said members is therefore very important for controlling them as regards relative positions, time and speed phasing of such members both in relation to each other and with respect to the thread that is adopted, manipulated and exchanged by said members, controlling the successful completion of each step of the process.

BRIEF SUMMARY OF THE INVENTION

The present invention is relative to a device for controlling the positioning and the configuration of the path of the thread during the cycles operated by the service trolley for the open-end spinning machine. The purpose of the present invention is that of making a device for controlling the positioning of the thread during the intervention cycles of the trolley that overcomes the described drawbacks of the devices available in the state of the art and allows greater efficiency of the trolley and greater yield of the spinning machine to be obtained, reducing the idle time due to the repetition of interventions on the spinning units.

To better highlight the problems tackled and the technical solutions proposed with the present invention we thus refer, in the following description, to a scheme of a trolley in which the device according to the invention is inserted, for servicing an open-end spinning machine, as a non-limiting example, with the explicit warning that it can advantageously also be used in a trolley in which the groups and the service members are different in type and arrangement.

BRIEF DESCRIPTION OF THE SEVERAL VIEWS OF THE DRAWINGS

FIGS. 4 to 7 show the relative positions of the members of the trolley C described up to now, according to a side view of the members of the trolley facing the spinning unit seen in profile, and illustrate some of the configurations and functions that the device according to the invention takes up and performs during the intervention cycles carried out by an automation trolley for open-end spinning machines.

DETAILED DESCRIPTION OF THE INVENTION

The device according to the invention is defined, in its essential components, in the first claim whereas its variants and preferred embodiments are specified and defined in the dependent claims.

Figure 1:
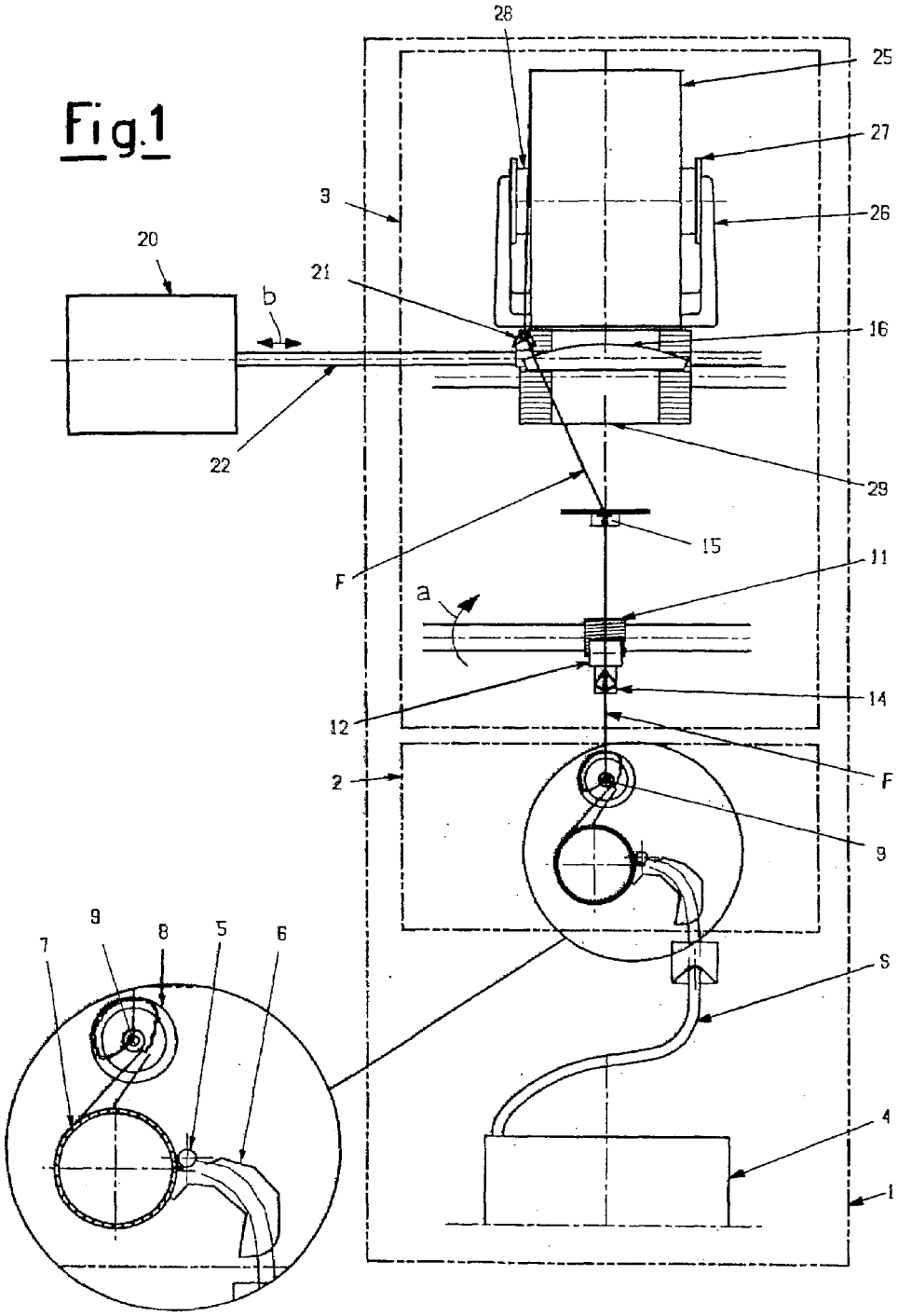
FIG. 1 illustrates the scheme of an open-end spinning station in its most significant components.
Figure 2:
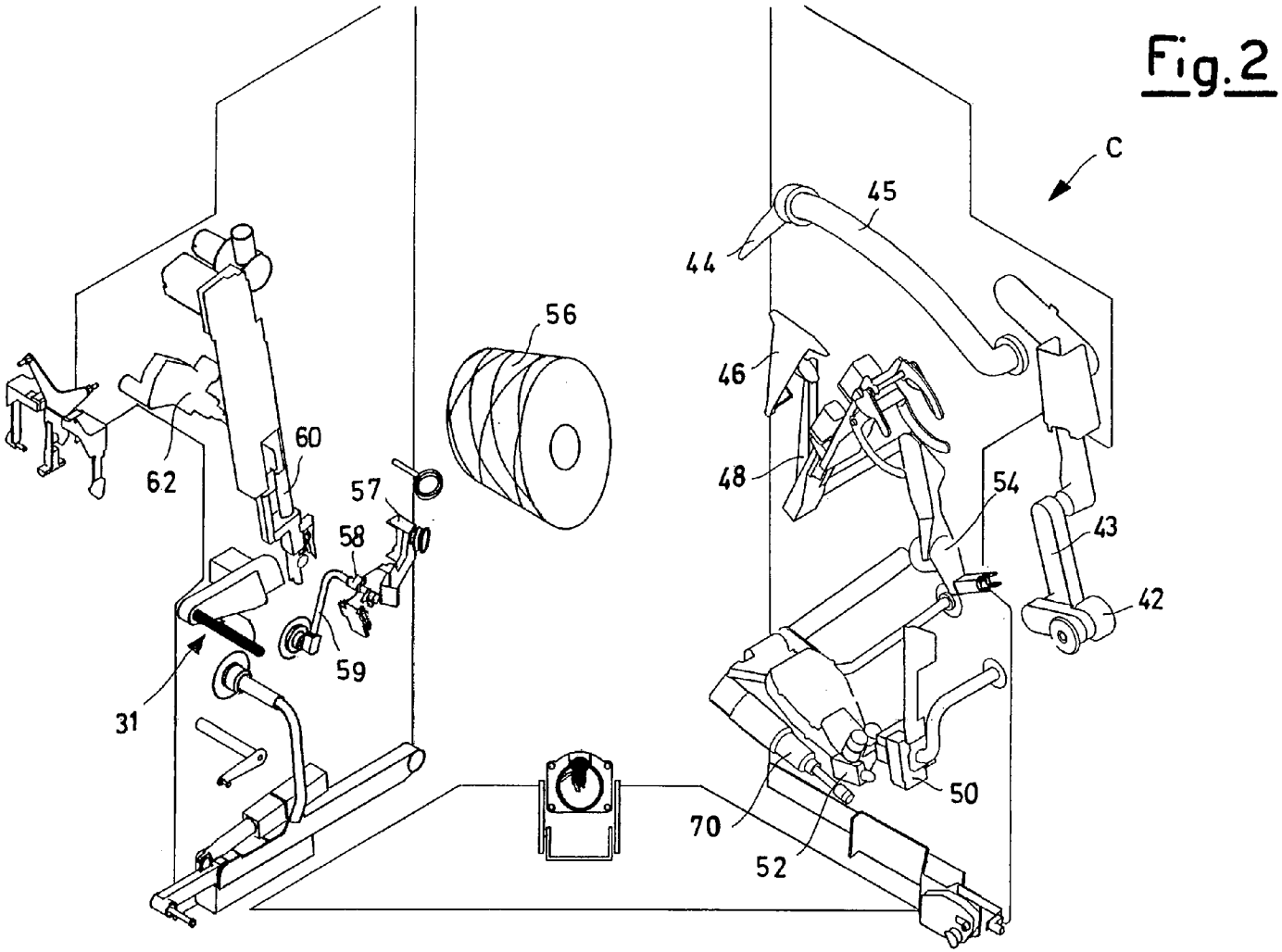
FIG. 2 illustrates a scheme of a service trolley C for an open-end spinning machine, in which the most significant members or groups that intervene in servicing as well as the device according to the invention for controlling and positioning the thread are indicated.

FIG. 2 shows an exploded view of the parallelepiped space inside the trolley C, in which its most significant members or groups for servicing the open-end spinning unit, including the device 31 according to the invention for controlling and positioning the thread are schematically indicated and, in particular, for the reattachment operations:

The device 31 for controlling and positioning the thread F during the intervention cycles that is described later on and in greater detail with reference to FIGS. 3, 8 and 9;

an auxiliary actuation roller 42 of the cone 25 or of the new quill 28, according to a clockwise/anti-clockwise rotation, during the service interventions. It can be moved forwards/backwards so as to be closer/further away with rotation of its arm 43 about a horizontal axis parallel to the front of the spinning machine. The rotation of the arm 43 is also used to discharge the finished cone pushing it towards the middle plane between the sides of the spinning machine;

a mobile suction mouth 44 for capturing the end of the thread on the side of the cone 25. It can be moved forwards/backwards so as to be closer/further away with rotation of its arm 45 about a horizontal axis parallel to the front of the spinning machine;

a centraliser device 46, consisting of an engagement and displacement fork of the thread captured by the mouth 44. It is equipped with a sensor 46S of the presence of thread inside of it and can be raised/lowered with rotation of its arm 48 about a horizontal axis parallel to the front of the spinning machine to serve the subsequent preparing group. More details on its structure and operation are described in patent EP 473.212;

a group 50 for preparing the end of the thread, mounted in a fixed position, which receives the thread from the centraliser 46, takes it, cuts it to size and prepares it for its re-introduction into the opening 9 of the spinning rotor 8. More details on its structure and operation are described in patent EP 443.220;

an introducing group 52 for gripping the end of the thread F prepared by the preparing group 50 and for supplying it to the spinning rotor 8 for the spinning to start up again. The introducing group also works in the lifting cycle operating on the auxiliary thread. It moves according to a trajectory from the preparing group 50 to the opening 9 to present the end of the thread to the rotor 8, which in rotation exerts a substantial sucking action;

a group 54 for lifting and opening the cone-holding arm 26, which disengages the cone from its roller 29 at the start and releases it at the end of each intervention cycle. The actuation open and closed of the tailstocks 27 allows—in lifting operations—the discharge of the finished cone and the insertion of a new quill 28, gripping the thread F between its base and tailstock 27.

As well as these groups, for the lifting and starting operations the following are foreseen:

a cone 56 of auxiliary thread A that is used to start spinning, in start-up or in lifting, with the tautening transmission 57 and the pincer 58 that has the auxiliary thread A. The pincer 58 is able to intersect both the trajectory followed by the introducing group 52 and that of the following gripping member 60, which can therefore take and control the auxiliary thread, take it to the preparer 50 and then go to introduce it to the spinning rotor 8 to carry out a reattachment of the auxiliary thread to the new thread in production. For such a purpose the pincer 58 is mounted on a motorised arm 59 that rotates in the plane of the figure and carries the auxiliary thread to be gripped by said manipulation members. Downstream of the pincer 58 there are scissors that, when the auxiliary thread A has been presented and gripped by such members, cut the thread leaving its end upstream still in the pincer 58, ready for it to be subsequently taken.

a hooked gripping member 60 with suction mouth for capturing, moving and centring both the auxiliary thread and the initial new thread, to present it both to the reattachment members of the auxiliary thread during the lifting cycle and to grip the new thread between quill 28 and tailstock 27. Such a hook with mouth 60 is equipped with a V-shaped centrer and is mounted on an arm 61 that can be extended and rotated about a horizontal axis parallel to the front of the spinning machine;

a device 62 for depositing and binding an initial reserve of thread at the end of the new quill 28. More details on its structure and operation are described in patent EP 340.863.

The members of the trolley are managed by the trolley's own control unit, which in turn communicates with the central control unit of the spinning machine and with the individual spinning stations. The trolley control unit coordinates the steps of the intervention cycles, imparts the actuation commands to its members and receives the detection thereof from the relative sensors and end stop, checking the positive outcome or not of each step taking the measures to suit the case.

Figure 3:
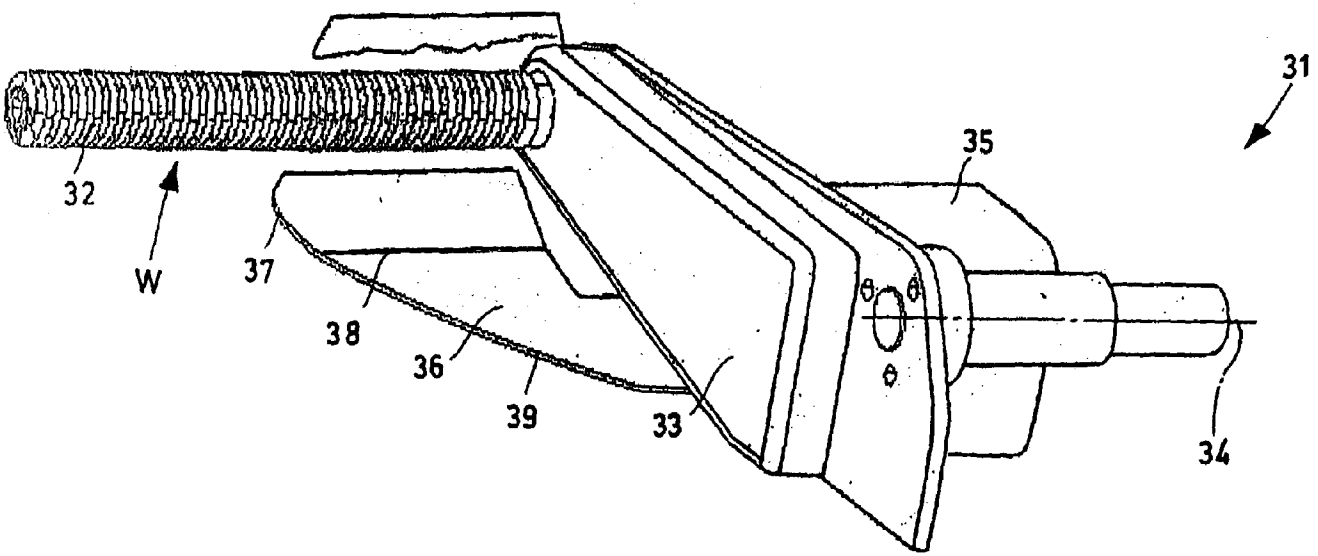
With reference to FIGS. 3, 8 and 9, the structure of the device according to the invention, its actuation and its movement during the steps of the cycles carried out by the trolley are illustrated.
Figure 8:
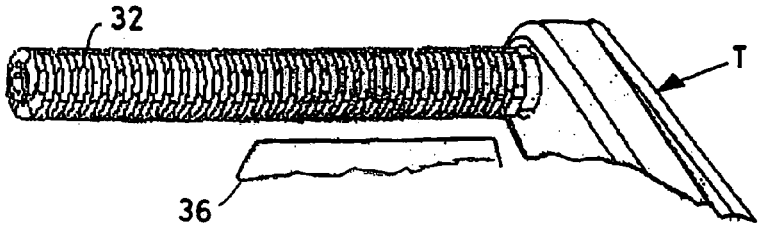
Figure 9:
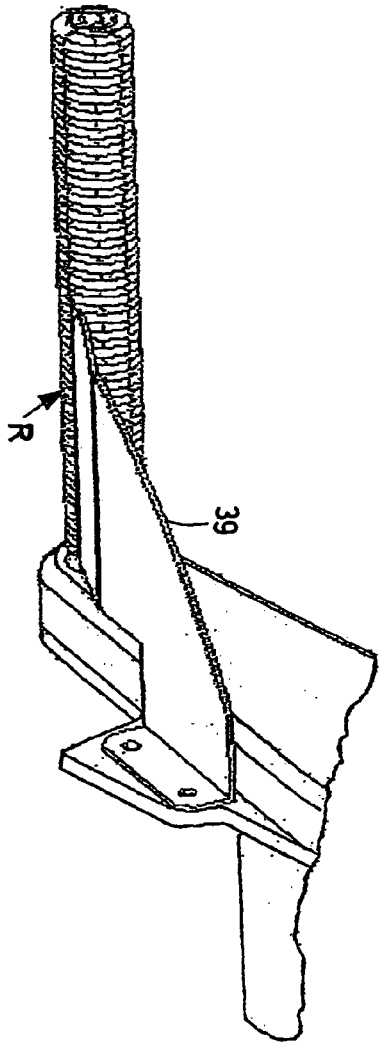

FIGS. 3, 8 and 9 illustrate typical embodiments of the device 31 according to the invention for controlling and positioning the thread during the interventions of the trolley. The device is shown in perspective. FIGS. 3, 8 and 9 each show the invention at a different typical position and level.

The device 31 is installed to the left of the front of the trolley and consists of a worm screw 32, with a horizontal axis parallel to the front of the spinning machine, having one of the ends free and the other occupied by a cantilevered support arm 33.

It can be lowered or raised by rotation of its support arm 33 that rotates about an axis 34, also with a horizontal axis parallel to the front of the spinning machine. On the support arm a motor 35 for actuating the worm screw 32 in clockwise/anticlockwise rotation is mounted, whereas the arm 33 is also equipped with actuation in rotation to typically take up three controlled angular positions that determine the level of the axis of the screw 32: rest R, work W and tautness T according to the needs of the intervention cycles. FIG. 8 depicts the position T. FIG. 9 depicts the position R.

According to a preferred embodiment of the present invention, a deviator plate 36 in the form of an asymmetrical hollow hut is fixed onto the inner part of the support arm 33, with an apex 37 and a fold 38 that lifts its external profile 39, farthest from the screw 32. The deviator plate 36 is thus integral with the worm screw 32 and follows it in its work and rest positions.

In general, the worm screw 32 has a diameter of 15–30 mm with rectangular threading with bevelled edges with a pith of 4–8 mm. It is equipped with actuation into commanded clockwise/anti-clockwise rotation with a speed in the order of hundreds of revs/min. To carry out the present invention the actuation motor 35 of the screw 32 can be a brushless motor driven in frequency by the trolley control unit to obtain angular positions and speeds that are controlled in the two directions of rotation.

According to a preferred embodiment of the present invention the actuation motor 35 of the screw 32 is a stepper motor driven in steps by the trolley control unit, again to obtain angular positions and speeds that are controlled in the two directions of rotation.

Figure 4:
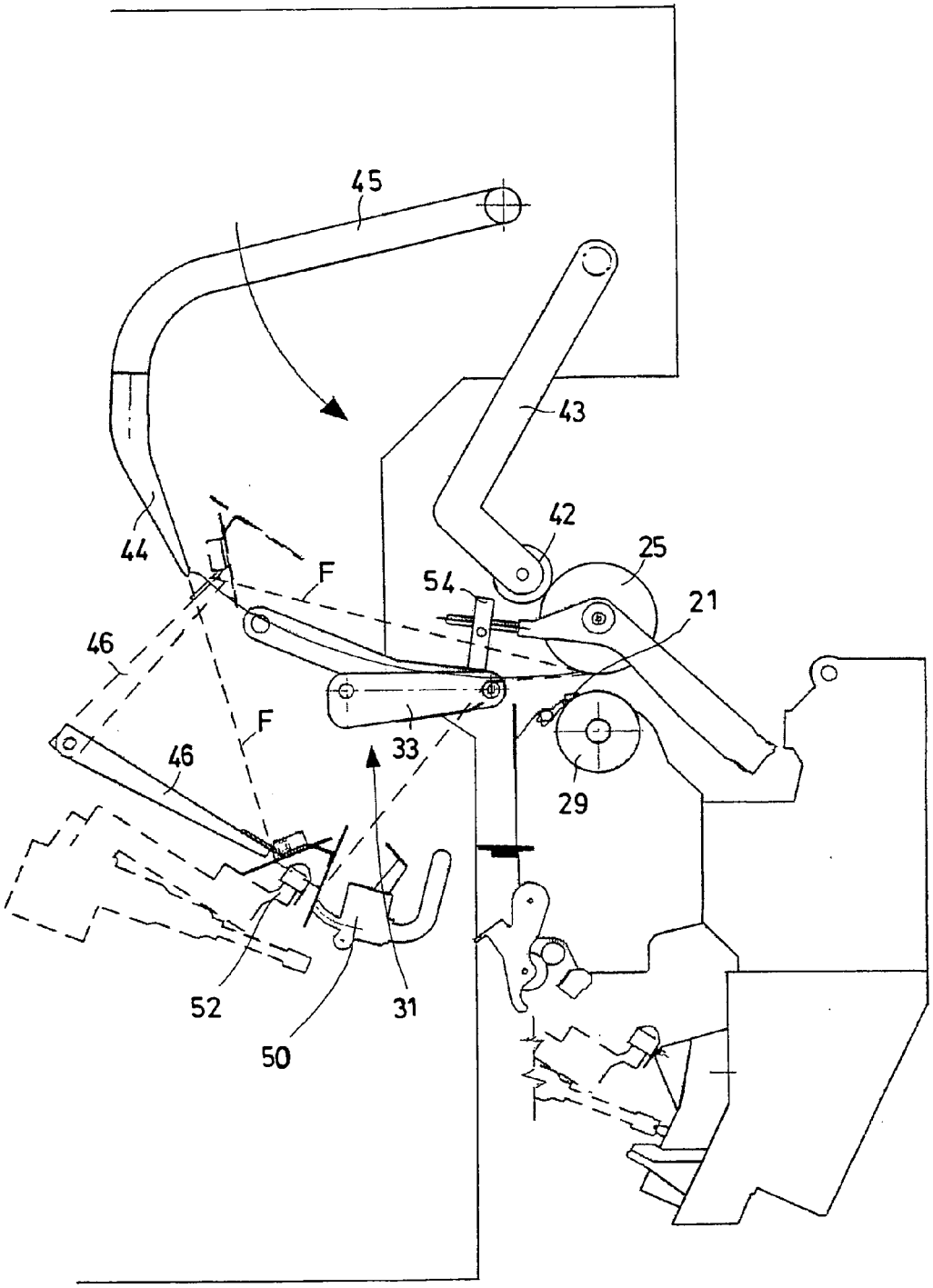

To illustrate the operation and the characteristics of the device 31 for controlling and positioning the thread during the interventions of the trolley more clearly, the relevant steps of the reattachment cycle are outlined hereafter, with reference to FIGS. 4–5, which show the positions taken up by the members of the trolley.

In general, the interruption of the thread is indicated by the sensor 15 of the presence of thread, at the entry of the collection unit 3. Following such a signal, the peripheral control unit of the unit takes care of lifting the cone 25 disengaging it from its cylinder 29, braking the cone itself and requesting the intervention of the service trolley. The roller 5 for supplying the rove S to the spinning unit 2 is equally stopped. The other spinning units continue to work: the members with common actuation—for example the shaft 22 that carries the thread guide 21— continue their motion even with the collection unit 3 stopped.

Upon the arrival of the service trolley C in position opposite the spinning unit to be serviced, the control unit starts off the intervention cycle coordinating the operations of the various members involved. Its lifting group 54 further lifts the cone 25, leaving it idle; the arm 43 is then rotated until it makes the auxiliary roller 42 for actuating the cone 25 rotate, during the reattachment interventions. The mobile suction mouth 44 for capturing the end of the thread on the side of the cone 25, shown already in withdrawn position with the thread F captured, is equally moved closer and then withdrawn. The joint action of the roller 42, actuated in rotation to unwind the thread F already wound on the cone 25, and of the suction with the mouth 44 picks up the thread F that—in its unwinding—is animated by a traversing motion, i.e. back and forth transversal motion.

The centraliser device 46 is also actuated, lowering it to take the thread F in its gripping fork.

With the coordination of the trolley control unit, the device 31 is lifted by rotation of a support arm thereof 33 from the rest position R to the work position taking its worm screw 32 adjacent and parallel to the cone 25. The combination of the movement of the centraliser 46 with the lifting of the screw 32 intercepts the thread F animated by its traversing motion, whereas it is unwound from the cone 25 by the mouth 44. In the elongated narrow opening of the mouth the thread F firstly oscillates quickly between right and left and then, with the mouth withdrawn, stabilizes.

FIG. 4 illustrates the relative positions of the members of the trolley C described up to now, according to a side view of the members of the trolley facing the spinning unit seen in profile. The raising of the screw 32 keeps the thread F coming from the cone 25 detached from the trajectory of the thread guide 21 that continues its alternate motion and that could tear it away from the mechanisms of the trolley.

Having ensured with non-interference of the thread guide, the device 31 operates to centralize the thread F, animated by the traversing motion.

Looking at the device 31 raised in work position W from the side of the trolley towards the cone 25, the screw 32 is made to rotate in the clockwise direction to take the thread towards the arm 33 (referring to FIG. 3 from left to right). The thread that unwinds from the cone, continuing its traversing motion, rests upon the device 31: if the thread F is on the right, it slides on the profile 39 of the deviator plate 36 without being captured by the screw in rotation up to its apex 37—which constitutes the stable resting point of the thread—and remains here in centred position without following the traversing oscillation, since it is prevented from doing so by the rotation of the screw 32. If, on the other hand, the thread F is on the left, it falls into the recess of the threading of the worm screw and is engaged in it and transported by its rotation towards the centre up to the stable resting point of the thread, i.e. the apex 37 of the plate 36. The thread F, once it has come into contact with the apex 37, easily passes over the bevelled threading of the screw in rotation, due to its low tension and due to the low winding angle it remains in centred position without continuing its traversing motion.

The thread F is, indeed, subjected to a low tension corresponding to that necessary to unwind it from the cone. With the screw 32 in clockwise rotation, the thread F, arriving both from the right and the left, always centralizes at the middle of the screw at the apex 37 of the hut-shaped profile of the plate 36. The raising and rotation of the screw 32 thus leads to the stabilization of the path of the thread F unwound between screw 32 and the centraliser 46, which continues to be sucked by the mouth 44 whilst it is still unwinding from the cone 25.

When the rotation of the arm 48 has taken the centraliser 46 into its final lowest position, indicated with a full line, it has taken the thread F to take up a V-shaped progression between the cone 25, the screw 32, the V of the centraliser 46 and the mouth 44. In the lowest point of such a V-shaped path there is the preparer 50 of the thread F.

As already stated, the preparing group 50 of the end of the thread is mounted in fixed position, receives the thread from the centraliser 46, takes it, cuts it to size and prepares it for its reintroduction into the opening 9 of the spinning rotor 8.

After the delivery of the thread F to the preparer, both the mouth 44 and the centraliser 46 can go back to rest, having completed their task. The configuration is now that of FIG. 4bis.

FIG. 5 shows the final step of the reattachment cycle. At the end of the thread preparation stage, the group 50 delivers a tapered end of predetermined length to the introducing group 52. The introducing group consists of a sort of pincer of the end of the prepared thread F that moves according to a work trajectory from the preparing group 50, from an initial position on the left to an end position on the right in FIG. 5, to insert and tauten the end of the thread at the opening 9 of the rotor 8. During the final stages of the reattachment cycle, the thread F is now in centralized position and thus easily goes back both into the sensor 15 of the thread and under the mobile roller 12, during the restarting steps of normal spinning.

In the meantime the supply of the rove S to the rotor 8 is started once again, so that the end of thread is firstly introduced and the withdrawn from the opening 9 after having caught the thread and thus recommenced spinning. The actuation of supply in the reattachment step is carried out with a telescopic rotating shaft 70 that extends to engage and actuate the supply roller 5 of the rove for the necessary time. Such a member is installed in the same introducing group 52 of the end of the thread in reattachment.

The cone 25 is again actuated with the auxiliary roller 42 but now with rotation to wind a new thread F onto it that is produced with acceleration until the linear operating speed is reached, with the thread still engaged and deviated on the screw 32. According to a preferred embodiment of the present invention, in the actuation of the arm 33 of the device 31 about the axis 34 a controlled angular position of tautness T is also foreseen so that, during the introduction step of the end and the catching of the new thread, the arm 33 can raise further with a brief controlled stroke so that the thread and end are always very taut and cannot get entangled or give rise to knots. This movement is highly coordinated, in time and in length of stroke, with the introduction and withdrawal operation from the rotor 8 of the end that catches the new fibres from the throat of the rotor itself.

The screw 32 is then rotated to make the thread, which has been taken into the hollow spiral of the threading, advance from its middle to its free end, to disengage it from it. When normal spinning has restarted, the new disengaged thread is once again hooked by the thread guide 21 whereas the lifting group 54 rests the cone 25 once again on its roller 29 and the auxiliary roller 42 is moved away.

Figure 6:
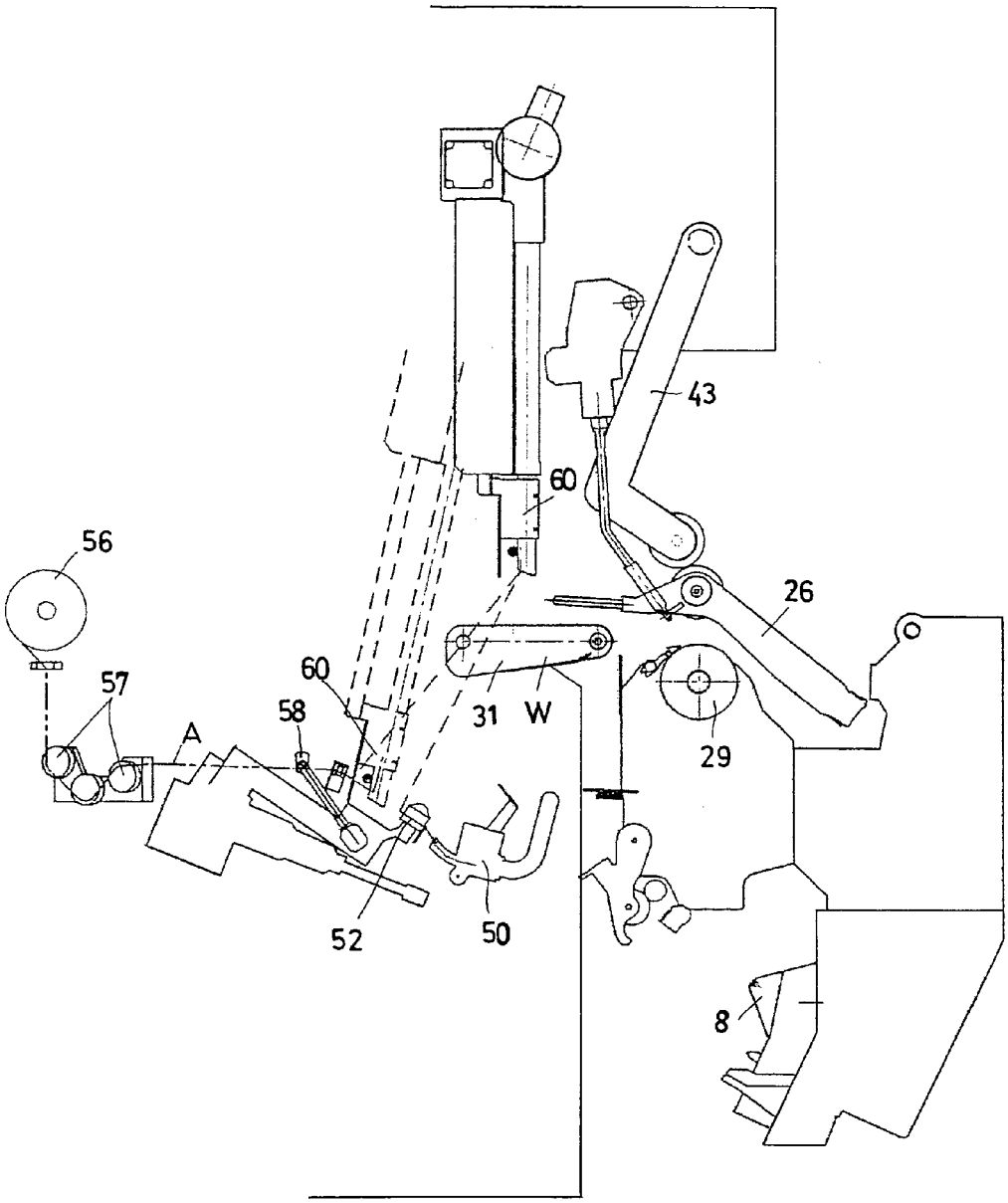
Figure 7:
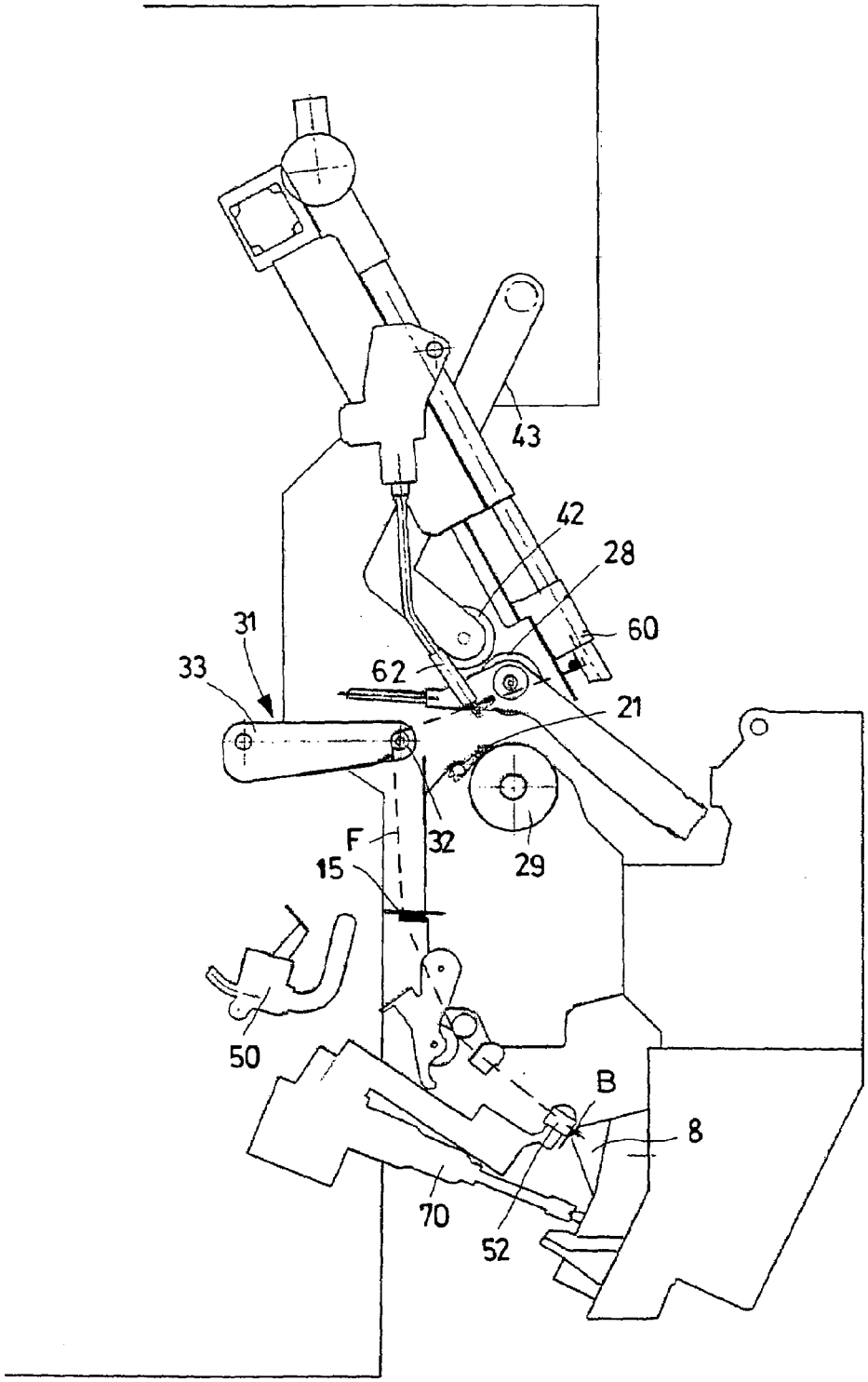

To illustrate the operation and the characteristics of the device 31 for controlling and positioning the thread also during the lifting cycle, its relevant steps are outlined with reference to FIGS. 6–7, which show the positions taken up by the members of the trolley involved in lifting.

In general, once the limit length foreseen for the cone 25 has been reached the spinning is stopping giving off a signal. As for the reattachment cycle, the peripheral control unit of the unit takes care of lifting the cone 25 disengaging it from its cylinder 29, braking the cone itself and requesting the intervention of the service trolley. When the service trolley C had arrived in position in front of the spinning unit to be serviced, its raising group 54 further lifts the cone 25, leaving it idle; the arm 43 is then rotated up to its maximum extension to take the auxiliary actuation roller 42 against the finished cone 25, to discharge it with a push towards the middle between the sides of the spinning machines where a conveyor belt device, already known in the prior art, periodically evacuates the finished cones that have been pushed into the middle between the two sides of the machine.

As already stated, the raising group 54 also operates the opening and closing of the tailstocks 27 of the arm 26 for the discharge of the finished cone and the insertion of a new quill 28. A gripping and presentation member of the new quill that will have to constitute the support on which the new cone 25 shall form is also brought closer. For the sake of simplicity these members are not shown in the figures, since they are well known in the state of the art.

The introducing group 52 withdraws to take and grip the auxiliary thread A between its members and advances into the position shown in FIG. 6, with a length of the end B before it. The thread A is taken between the introducing group 52, the pincers 58 and continues towards the cone of auxiliary thread 56. The member 60 for gripping the thread lowers down (position with a broken line) and takes the thread from the pincer 58, raises up and turns in the anti-clockwise direction into the position shown in FIG. 6 (position with a full line) taking a length of thread away from the cone 56. The thread A is then cut from the side of the pincers 58 and takes up the end configuration of FIG. 6. The device 31 is raised into the work position W, but with the screw 32 immobile. From the introducer 52 the end B is introduced, cut to size and prepared in the preparer 50.

As shown in FIG. 7, the unit operates like in the reattachment cycle: the introducer 52 introduces the end B into the opening 9 of the rotor 8, to pick up, with the end B of the auxiliary thread A, the new thread formed with the fibres of the rove S once again supplied to the unit. The new thread is rested at the centred of the device 31, i.e. at the stable resting point of the thread, in the apex 37 of the plate 36. In such a position the new thread is tautened and is introduced into the thread sensor 15.

The newly produced thread is sucked with the mouth of the member 60, to eliminate the portion of auxiliary thread. The gripping member 60 is advanced further towards the spinning unit inserting—in cooperation with the device 31—the new thread between the base of the quill 28 and its tailstock 27 that is still open.

The screw 32 is, indeed, placed in anti-clockwise rotation to take the new thread F towards the arm 33. The thread has a substantially higher winding and tension angle than in the reattachment cycle and is able to advance up to the end stop at the start on the side of the arm 33 and be inserted under the plate 36, until it reaches the axial coordinate of the space between the base of the quill 28 and its open tailstock 27. Indeed, it is necessary to take into account the circumstance that now the thread F is subjected to the normal spinning tension that is greater than that necessary to unwind it from the cone in the reattachment cycle.

When the thread has arrived between quill and open tailstock 27, the tailstocks are then closed locking the new thread F, the waste is cut and sucked up with the mouth of the member 60, the quill 28 is actuated into rotation with the auxiliary roller 42, then the device 62 for depositing and binding the reserve thread at the end of the new quill 28 is actuated. The normal path of the thread from rotor 8 to cone 25 is now re-established. The screw 32 is then put into clockwise rotation to displace the new thread F towards its free end and let it fall. The quill 28 of the new cone in formation is lowered onto its cylinder 29, whereas the thread is hooked by the thread guide 21 at the first useful passage. The trolley has completed its task, can withdraw its members to rest and can be directed towards the other units of the spinning machine.

The device 31 for controlling and positioning the thread with a screw 32/plate 36 allows multiple functions to be carried out in intervention cycles of the service trolley of an open-end spinning machine and, moreover, has substantial progressions with respect to devices of the prior art. Amongst these, at least the following deserve to be mentioned.

The device is able to have different behaviours: it may or may not transport the thread in the axial direction according to the values of the winding angle and its tension. In the reattachment cycle the thread F in any case has a low winding angle and little tension: even with the screw 32 in rotation to take the thread towards the arm 33, the thread manages to pass over the projections of the threading in rotation and always centralizes at the apex 37 of the plate 36. In the lifting cycle the thread has a greater winding angle and high tension with the screw 32 in anti-clockwise rotation towards the arm 33, the thread is forced to follow the threading in rotation and goes to the end stop towards the arm, whereas with its clockwise rotation the thread moves away from the arm 33, until it falls from the free end of the worm screw 32.

In the reattachment cycle, its controlled movement towards the position T synchronised with the excursions followed by the introducing group keeps the thread taut but without substantial tension. In work position W the device in any case keeps the thread protected from the excursions of the thread guide, also controlling its level.

During the disengagement step of the thread, at the end of the reattachment and lifting cycle, the device axially distributes the thread on the generatrix of the cone in formation, replacing the thread guide.

The invention claimed is:

1. Automatic service trolley for spinning units of open-end spinning machines for carrying out intervention cycles for starting, for reattachment of thread and lifting of completed cones of thread on individual spinning units, said trolley carrying on-board members or groups of members dedicated to single or multiple operations of the various cycles, as well as a device for controlling and positioning that determines the position, with respect to such members of the trolley, both of an auxiliary thread (A), which is adopted at a new quill (28) by the service trolley, and of the thread produced (F) that reaches a cone (25), characterized in that said device (31) for controlling the thread (A, F) consists of a worm screw (32), with a horizontal axis parallel to the front of the spinning machine, equipped with a cantilevered support arm (33) that allows it to be lowered or raised by rotation about a horizontal axis (34) parallel to the front of the spinning machine, the worm screw (32) being actuated into commanded clockwise/anticlockwise rotation by a motor (35), and the arm (33) also being actuated into rotation take up controlled angular positions that determine the level of the axis of the screw (32), and with it they determine the level at which the thread is carried, whereas the thread itself is engaged in the recess of the threading of the worm screw (32) and is transported in it by its rotation, which determines its axial coordinate, said automatic service trolley further characterized in that a deviator plate (36) in the form of a concave hut is fixed onto the support arm (33), with an apex (37) and a fold (38) that raises its external profile (39), said deviator plate being integral with the worm screw (32).

2. Automatic service trolley for spinning units of open-end spinning machines according to claim 1, characterized in that the worm screw (32) has a diameter of between 15 and 30 mm and is equipped with rectangular threading with beveled edges with a pitch of 4–8 mm.

3. Automatic service trolley for spinning units of open-end spinning machines according to claim 1, characterized in that the device (31) can go into three positions: rest (R), work (W) and tautness (T) according to the needs of the intervention cycles.

4. Automatic service trolley for spinning units of open-end spinning machines according to claim 3, characterized in that the device (31) can go into a work position (W) situated at a level that keeps the thread protected from the excursions of the thread guide (21).

5. Automatic service trolley for spinning units of open-end spinning machines according to claim 1, characterized in that the device (31) is equipped with actuation in rotation of the screw (32) with a brushless motor (35) driven in frequency by the trolley control unit to obtain angular positions and speeds that are controlled in the two directions of rotation.

6. Automatic service trolley for spinning units of open-end spinning machines according to claim 1, characterized in that the device (31) is equipped with actuation in rotation of the screw (32) with a stepper motor (35) driven in steps by the trolley control unit, again to obtain angular positions and speeds that are controlled in the two directions of rotation.

7. Automatic service trolley for spinning units of open-end spinning machines according to claim 1, characterized in that the device (31) is connected with a trolley control unit for the coordination of its operation with that of the other members on-board the trolley.

8. Automatic service trolley for spinning units of open-end spinning machines according to claim 1, characterized in that the worm screw (32) of the device (31) has its end stop at the side of the arm (33) corresponding to the axial coordinate of the space between the base of a quill (28) and an open tailstock of said quill (27).

* * * * *